US008668273B2

(12) United States Patent
Wang

(10) Patent No.: US 8,668,273 B2
(45) Date of Patent: Mar. 11, 2014

(54) HIGHCHAIR

(76) Inventor: Kun Wang, Taichung (TW)

( * ) Notice: Subject to any disclaimer, the term of this patent is extended or adjusted under 35 U.S.C. 154(b) by 293 days.

(21) Appl. No.: 13/240,120

(22) Filed: Sep. 22, 2011

(65) Prior Publication Data

US 2013/0076079 A1 Mar. 28, 2013

(30) Foreign Application Priority Data

Mar. 31, 2011 (CN) ..... 2011 1 0084313

(51) Int. Cl.
*A47D 1/00* (2006.01)

(52) U.S. Cl.
USPC ..... 297/467; 297/173; 297/327

(58) Field of Classification Search
USPC ..... 297/173, 326, 327, 344.14, 411.39, 467
See application file for complete search history.

(56) References Cited

U.S. PATENT DOCUMENTS

| | | | | | |
|---|---|---|---|---|---|
| 4,231,612 | A * | 11/1980 | Meeker | 297/256.13 |
| 5,165,755 | A * | 11/1992 | Rho | 297/344.18 |
| 5,364,137 | A * | 11/1994 | Shimer | 297/327 |
| 5,527,096 | A * | 6/1996 | Shimer | 297/327 |
| 6,089,653 | A * | 7/2000 | Hotaling et al. | 297/130 |
| 6,161,898 | A * | 12/2000 | Brevi | 297/328 |
| 6,347,833 | B1 * | 2/2002 | Chen | 297/328 |
| 6,715,827 | B1 * | 4/2004 | Chen | 297/148 |
| 7,905,549 | B2 | 3/2011 | Lake et al. | |
| 8,287,044 | B2 * | 10/2012 | Chen et al. | 297/327 |
| 2007/0145790 | A1 * | 6/2007 | Ventrola | 297/151 |

* cited by examiner

*Primary Examiner* — Peter Brown
(74) *Attorney, Agent, or Firm* — patenttm.us

(57) ABSTRACT

A highchair has a seat device, a bracket device and a table. The seat device has a base, a supporting sleeve and a seat. The bracket device is connected to the seat device and has two connecting segments, a connecting frame and a supporting arm. The connecting segments are respectively connected securely to the supporting sleeve and each has a connecting mount, a button seat, a pressing button and a button spring. The connecting frame connects to the connecting segments and has two inserting segments and a primary frame. The supporting arm is telescopically and pivotally connected to the connecting frame. The table is detachably mounted on the bracket device.

13 Claims, 14 Drawing Sheets

HIGHCHAIR

BACKGROUND OF THE INVENTION

1. Field of the Invention

The present invention relates to a highchair, and more particularly to a highchair that can be used safely.

2. Description of Related Art

A conventional highchair is disclosed in U.S. Pat. No. 7,905,549, with reference to FIG. 8 of the conventional highchair, the conventional highchair has a foot part 2, a seat element 4 and a table 32. The seat element 4 is connected to the foot part 2 and has two bearing bushings 82. Each bearing bushing 82 has an external surface and a depression 126. The depression 126 is formed around the external surface of the bearing bushing 82 and has an external surface and a latching lug catch 132. The latching lug catch 132 is formed on and protrudes from the external surface of the depression 126.

The table 32 is connected to the seat element 4 and has two hook-shaped fixing catches 120. The hook-shaped fixing catches 120 are respectively and detachably mounted around the bearing bushings 82 of the seat element 4 and each hook-shaped fixing catch 120 has an internal surface and a locking recess 124. The locking recess 124 is formed in the internal surface of the hook-shaped fixing catch 120 and is hooked with the latching lug catch 132 of a corresponding depression 126 to enable the table 32 to hold securely with the seat element 4. However, the engagement between the latching lug catch 132 and the locking recess 124 is not firm, and the hook-shaped fixing catches 120 of the table 32 may be separated from the bearing bushings 82 of the seat element 4 when the table 32 is knocked against an external force and this is not safe in use.

In addition, with reference to FIG. 16 in the present invention, another conventional highchair 90 has a base, a seat 91 and a table 94. The seat 91 is connected to the base and can be adjusted with multistage slant angles relative to the base. The table 94 is detachably connected to the seat 91 and has a connecting frame 93 and a supporting arm 92. The connecting frame 93 is connected to the seat. The supporting arm 92 is telescopically connected between the seat 91 and the connecting frame 93. The table 94 is mounted on the connecting frame 93. With reference to FIG. 17, when the seat 91 is adjusted to incline relative to the base, the supporting arm 92 will be pressed between the seat 91 and the connecting frame 93.

With reference to FIGS. 18 and 19, when a user wants to adjust the angle of the seat 91 to the lowest position, the supporting arm 92 is pressed to the shortest length and may prop the connecting frame 93 up. Then, the user needs to separate the supporting arm 92 and the connecting frame 93 from the seat 91 and the base before adjusting the angle of the seat 91 to the lowest position. However, when the user separates the supporting arm 92 and the connecting frame 93 from the seat 91 and the base, the baby sleeping in the chair may be waked by the separating sound.

To overcome the shortcomings, the present invention provides a highchair to mitigate or obviate the aforementioned problems.

SUMMARY OF THE INVENTION

The main objective of the present invention is to provide a highchair that can be used safely.

The highchair in accordance with the present invention has a seat device, a bracket device and a table. The seat device has a base, a supporting sleeve and a seat. The bracket device is connected to the seat device and has two connecting segments, a connecting frame and a supporting arm. The connecting segments are respectively connected securely to the supporting sleeve and each has a connecting mount, a button seat, a pressing button and a button spring. The connecting frame connects to the connecting segments and has two inserting segments and a primary frame. The supporting arm is telescopically and pivotally connected to the connecting frame. The table is detachably mounted on the bracket device.

Other objectives, advantages and novel features of the invention will become more apparent from the following detailed description when taken in conjunction with the accompanying drawings.

DETAILED DESCRIPTION OF PREFERRED EMBODIMENT

Figure 1:
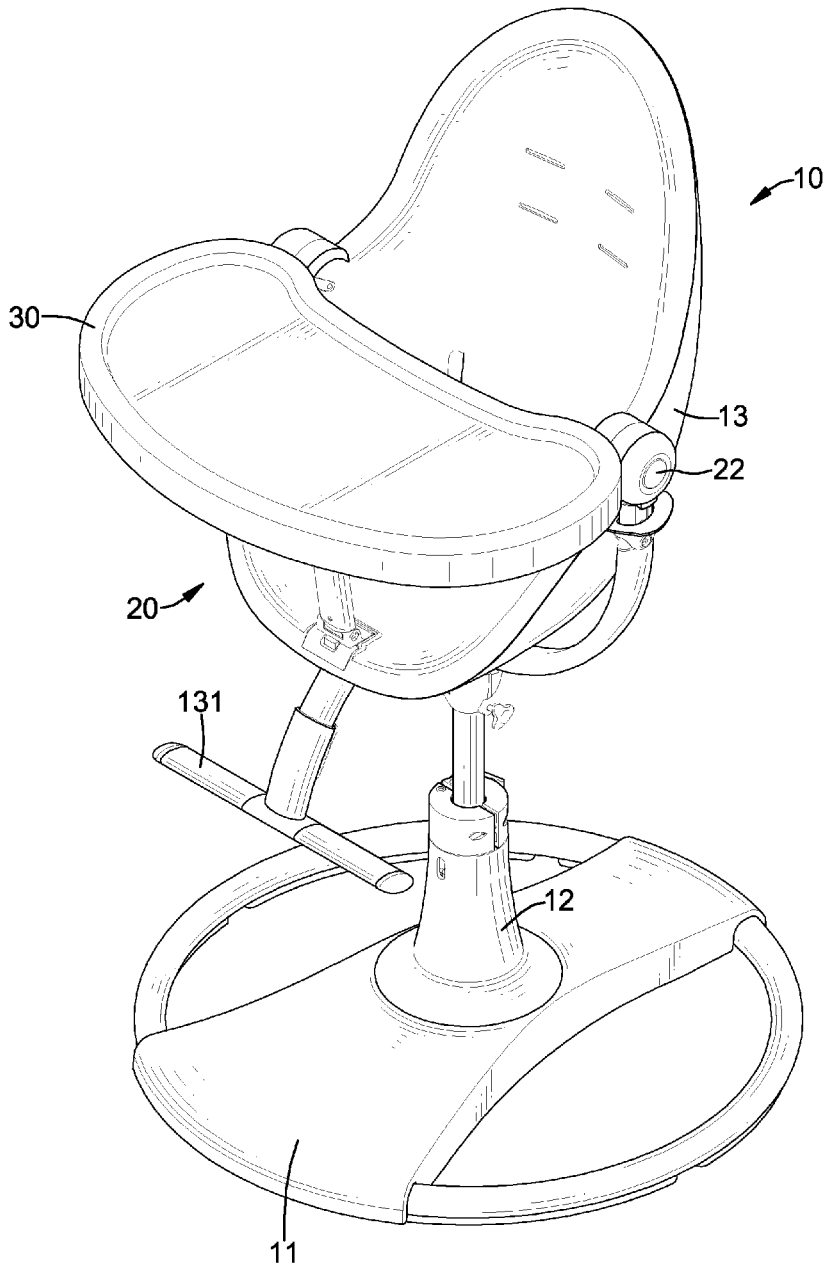
FIG. 1 is a perspective view of a highchair in accordance with the present invention.
Figure 2:
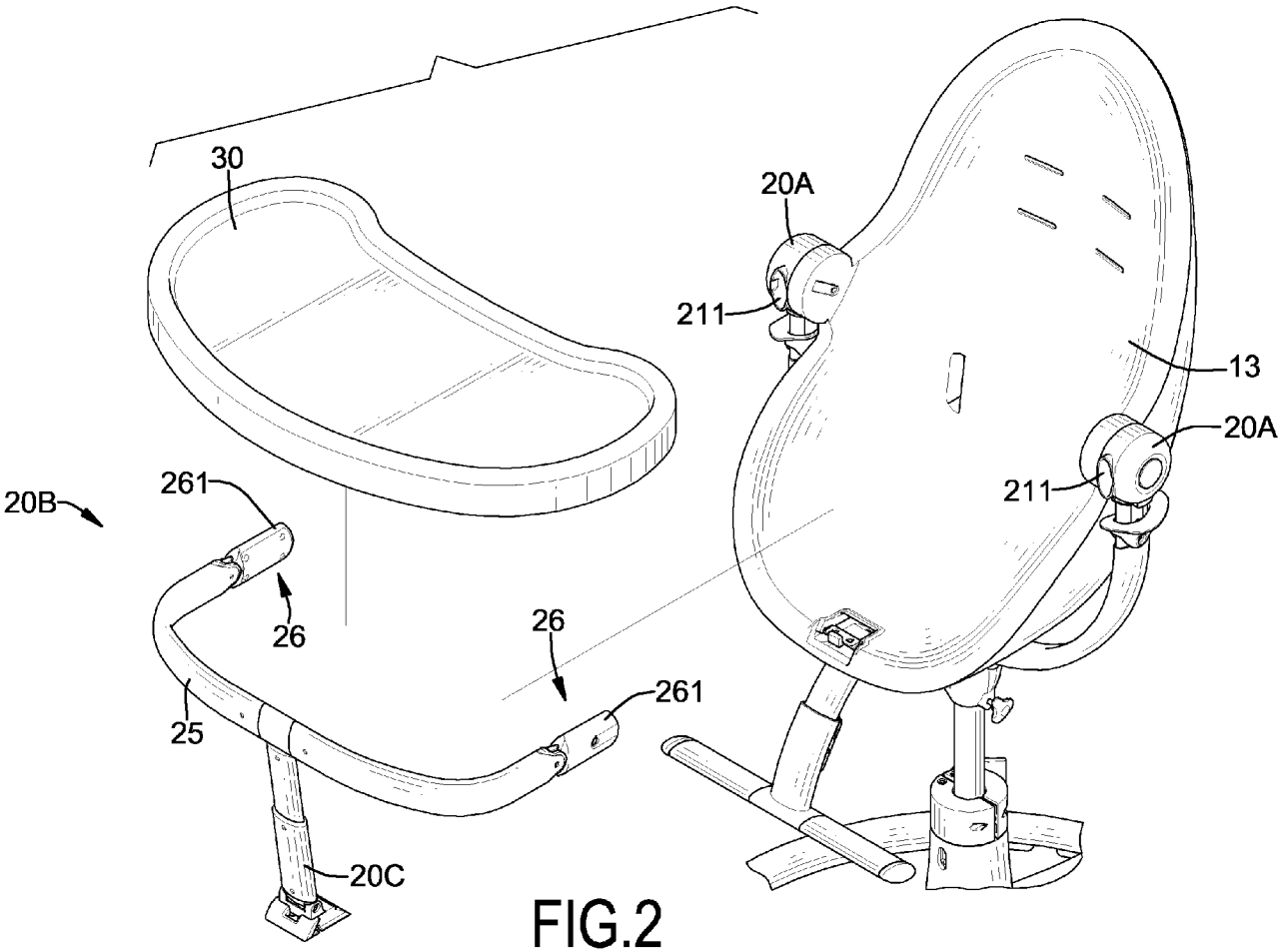
FIG. 2 is an exploded perspective view of the highchair in FIG. 1.

With reference to FIGS. 1 and 2, a highchair in accordance with the present invention has a seat device 10, a bracket device 20 and a table 30.

The seat device 10 has a base 11, a supporting sleeve 12 and a seat 13. The base 11 may be circular and has a center. The supporting sleeve 12 is formed on and protrudes from the center of the base 11 and has two top ends. The seat 13 is detachably connected to the supporting sleeve 12 between the top ends above the base 11 and has a lower end, two sidewalls and a footrest 131. The footrest 131 is connected to the lower end of the seat 13 to provide a lug-holding effect to a baby in the chair.

The bracket device 20 is connected to the seat device 10 and has two connecting segments 20A, a connecting frame 20B and a supporting arm 20C.

With reference to FIGS. 2 to 5, the connecting segments 20A are respectively connected securely to the top ends of the supporting sleeve 12 and each connecting segment 20A has a connecting mount 21, a button seat 23, a pressing button 22, a button spring 24, a holding lever 28 and a holding lever spring 27. The connecting mount 21 is mounted securely on a corresponding top end of the supporting sleeve 12 and has an inner side, an outer side, a front side, a bottom side, a mounting hole, a seat hole and an inserting hole 211. The inner side of the connecting mount 21 is connected to one of the sidewalls of the seat 13. The mounting hole is formed through the bottom side of the connecting mount 21 and is mounted around the corresponding top end of the supporting sleeve 12. The seat hole is formed in the outer side of the connecting mount 21 and communicates with the mounting hole. The inserting hole 211 is formed through the front side of the connecting mount 21 and communicates with the mounting hole and the seat hole of the connecting mount 21.

The button seat 23 is mounted securely in the seat hole of the connecting mount 21 by fasteners and has a center and a through hole. The through hole is formed through the center of the button seat 23 and communicates with the seat hole, the mounting hole and the inserting hole 211 of the connecting mount 21.

Figure 10:
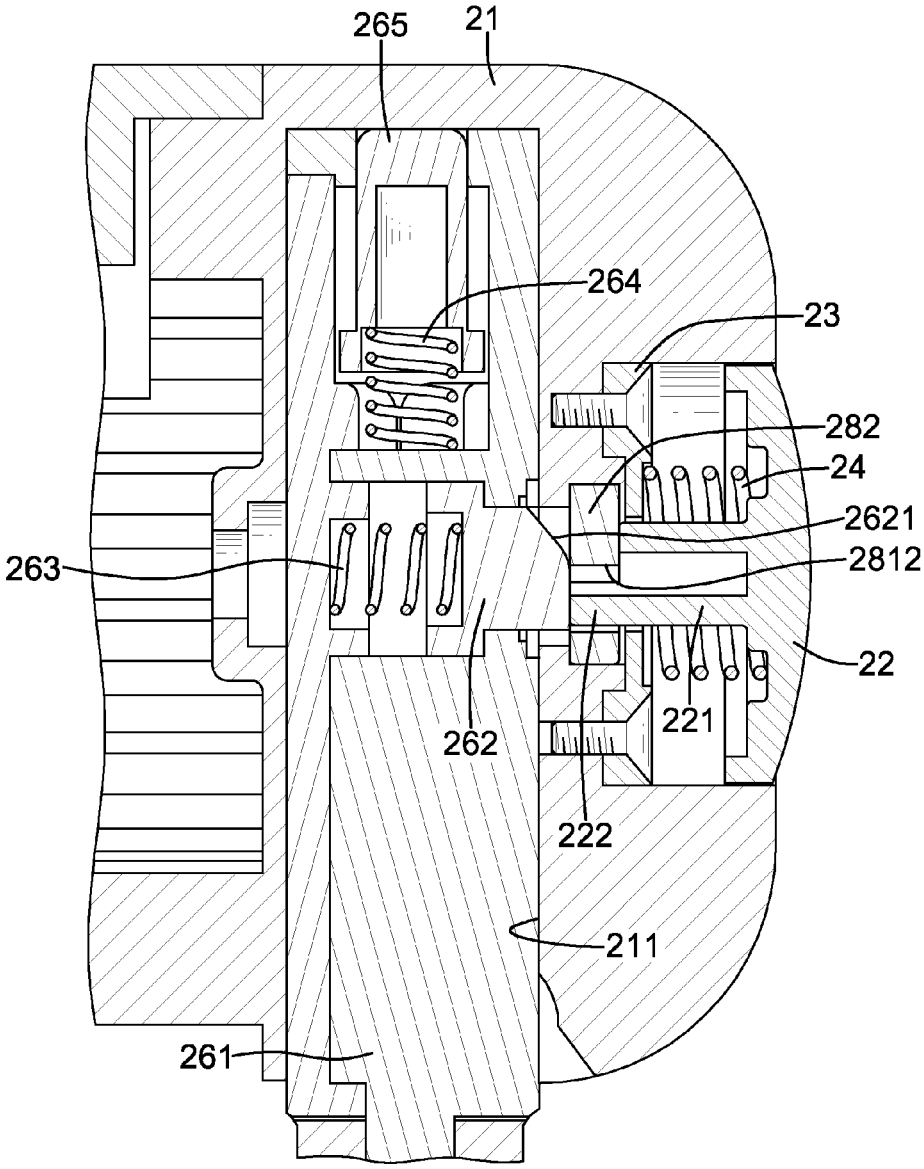
FIG. 10 is a cross section side view of the connecting segment and the connecting frame of the highchair in FIG. 1.

The pressing button 22 is pressably mounted in the seat hole of the connecting mount 21, is connected to the button seat 23 and has an inner side, a center, a pressing protrusion 221 and multiple hooks 223. The pressing protrusion 221 is formed on and protrudes from the inner side of the pressing button 22 and has a diameter, a free end, a stopping surface 224 and a positioning block 222. With reference to FIG. 10, the free end of the pressing protrusion 221 extends in the through hole of the button seat 23. The stopping surface 224 is formed on the free end of the pressing protrusion 221.

The positioning block 222 is partially formed on and protrudes from the stopping surface 224 of the pressing protrusion 221 and extends into the mounting hole of the connecting mount 21 via the through hole of the button seat 23. The hooks 223 are formed on and protrude from the inner side of the pressing button 22 at intervals around the pressing button 22 and are hooked to the button seat 23 to hold the pressing button 22 in the seat hole of the connecting mount 21. The button spring 24 is mounted around the pressing protrusion 221 of the pressing button 22 and abuts between the button seat 23 and the inner side of the pressing button 22.

Figure 3:
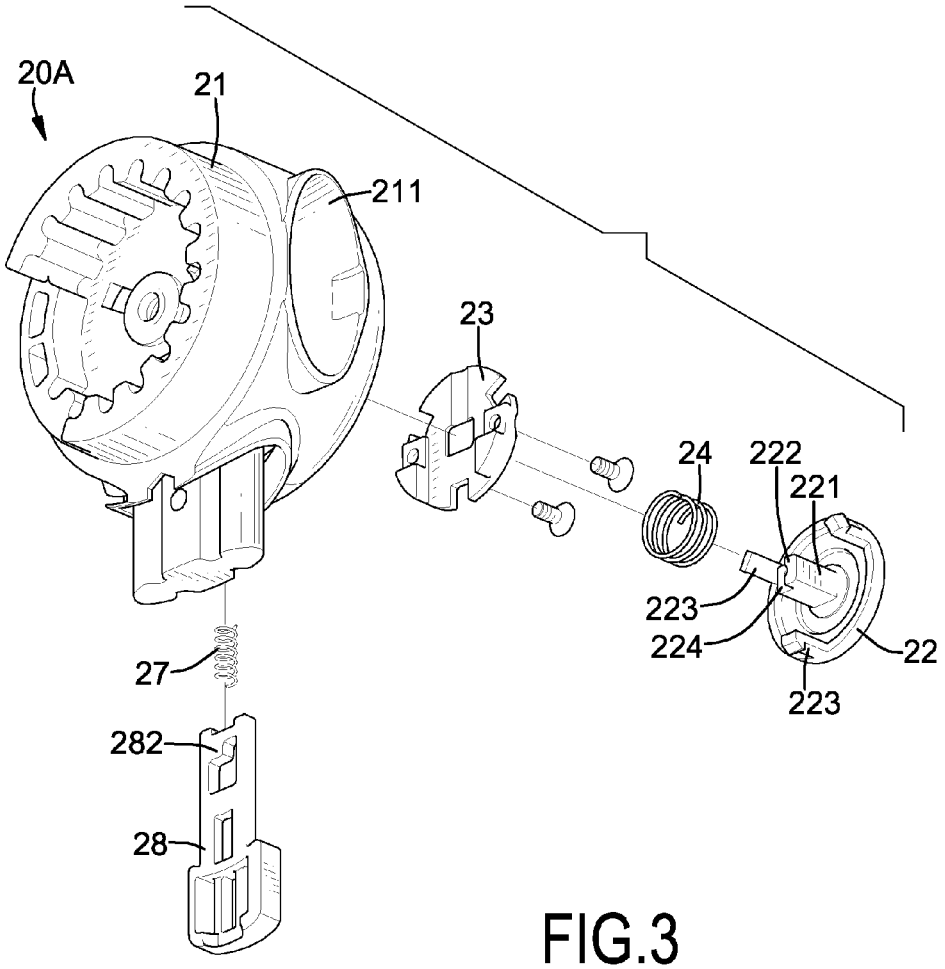
FIG. 3 is an enlarged and exploded perspective view of a connecting segment of the highchair in FIG. 1.
Figure 4:
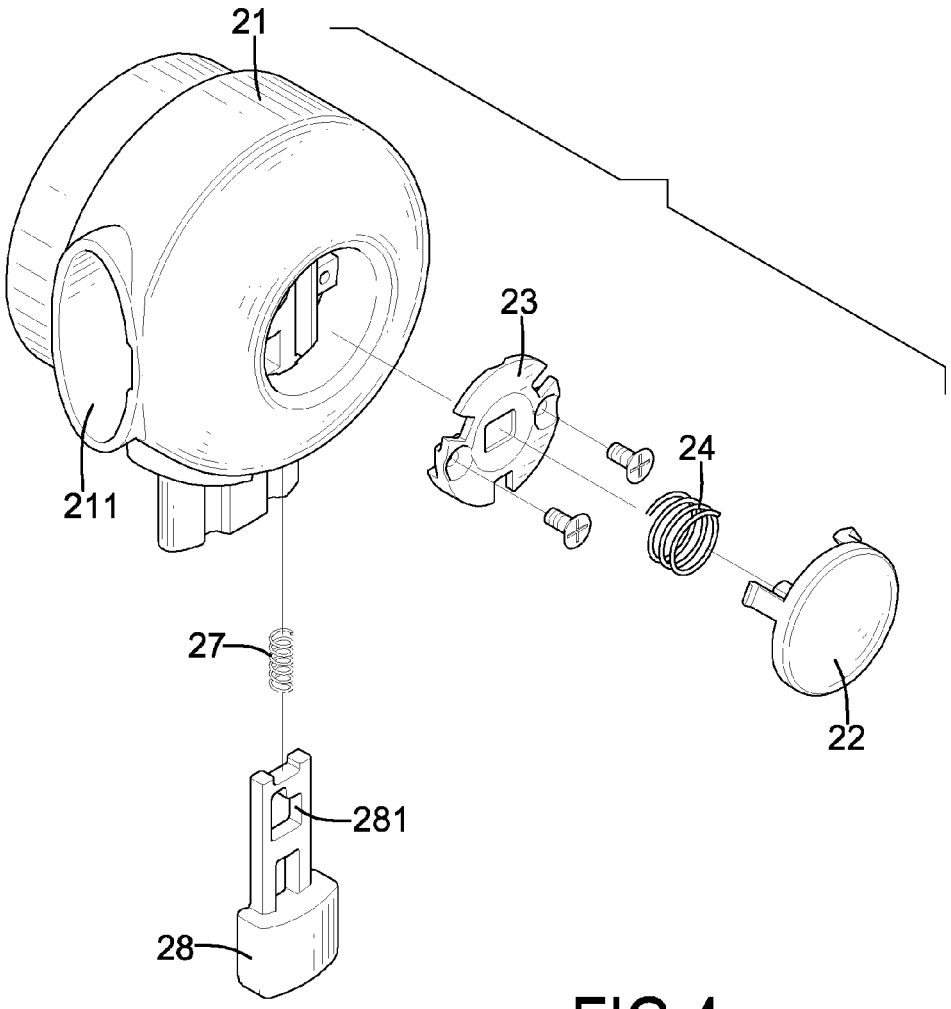
FIG. 4 is another enlarged and exploded perspective view of a connecting segment of the highchair in FIG. 1.
Figure 6:
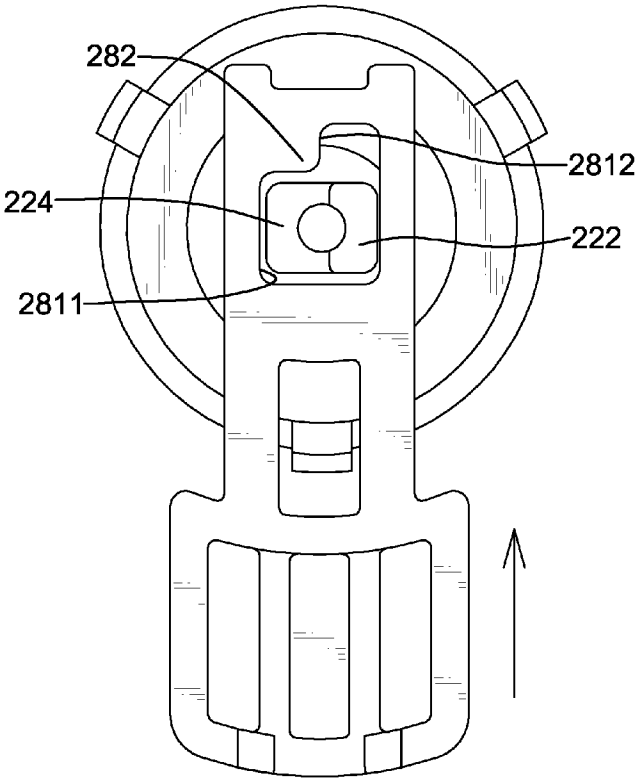
FIG. 6 is an enlarged and operational side view of the connecting segment of the highchair in FIG. 5.
Figure 5:
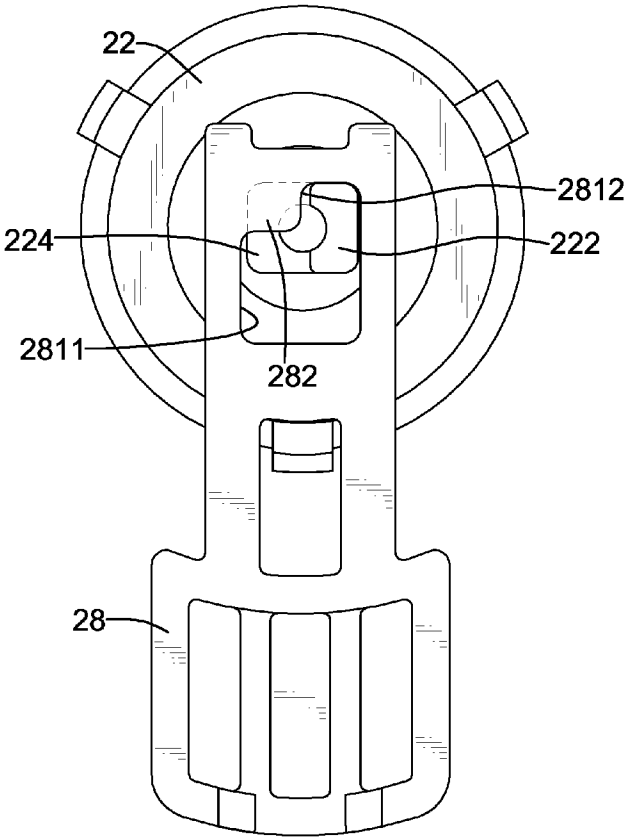
FIG. 5 is an enlarged side view of the connecting segment of the highchair in FIG. 3.
Figure 7:
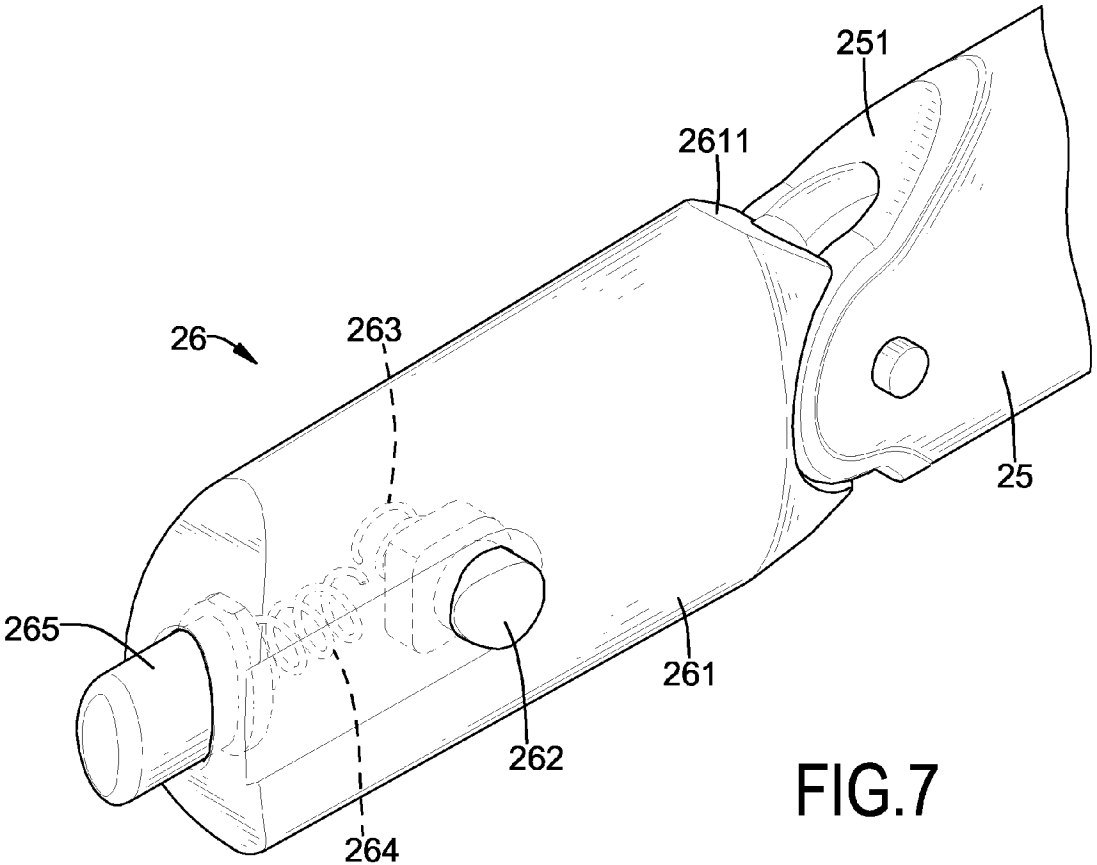
FIG. 7 is an enlarged perspective view of a connecting frame of the highchair in FIG. 1.
Figure 8:
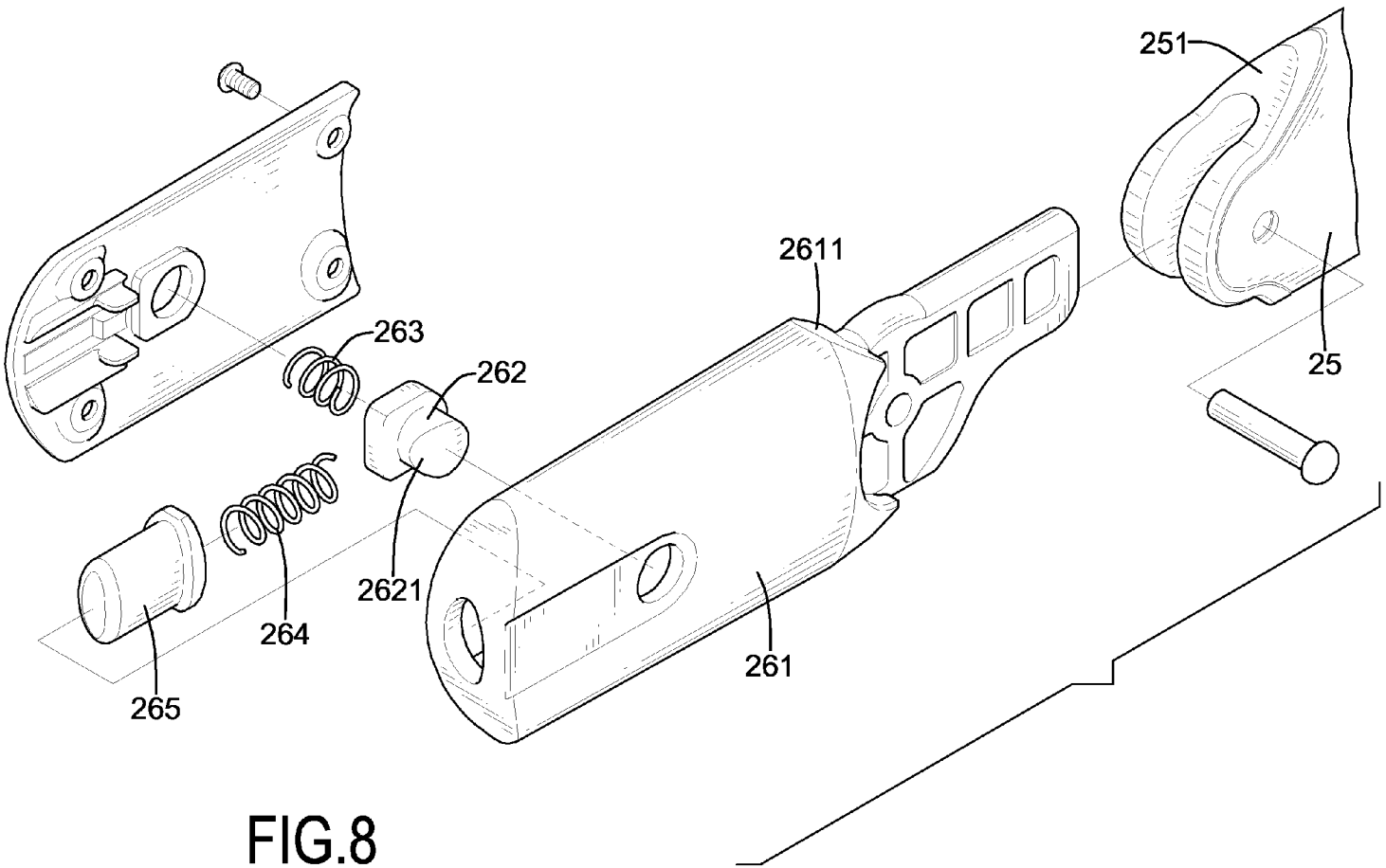
FIG. 8 is an enlarged and exploded perspective view of the connecting frame of the highchair in FIG. 7.

With reference to FIGS. 3, 5 and 6, the holding lever 28 is mounted movably in the connecting mount 21 via the mounting hole of the connecting mount 21 and has a holding end, a holding hole 281 and a stopping protrusion 282. The holding end of the holding lever 28 is mounted in the mounting hole of the connecting mount 21. The holding hole 281 is formed through the holding end, is mounted around the positioning block 222 of the pressing protrusion 221 and has an upper section, a lower section, a positioning region 2812 and a through region 2811. The positioning region 2812 is defined in the upper section of the holding hole 281, engages the positioning block 222 of the pressing protrusion 221 and has a diameter. The through region 2811 is defined in the lower section of the holding hole 281 below the positioning region 2812 and has a diameter wider than the diameter of the pressing protrusion 221. Then, the pressing protrusion 221 can be moved through the holding lever 28 via the through region 2811 of the holding hole 281.

The stopping protrusion 282 is formed on the holding lever 28 and protrudes inward the upper section of the holding hole 281 and abuts the stopping surface 224 of the pressing protrusion 221. The holding lever spring 27 is mounted between the connecting mount 21 and the upper end of the holding lever 28 to enable the stopping protrusion 282 to abut the stopping surface 224 of the pressing protrusion 221 and to enable the positioning block 222 to be mounted in the positioning region 2812 of the holding hole 281.

With reference to FIGS. 2 and 7 to 10, the connecting frame 20B connects to the connecting segments 20A and has two inserting segments 26 and a primary frame 25. The inserting segments 26 are respectively inserted in the inserting holes 211 of the connecting segments 20A and each inserting segment 26 has an inserting arm 261, a locking button 262, a locking button spring 263, an ejecting button 265 and an ejecting button spring 264. The inserting arm 261 has an inserting end, a connecting end, an inner side, an outer side and two inclined faces 2611. The inserting end of the inserting arm 261 is inserted in the inserting hole 211 of the corresponding connecting mount 21. The inclined faces 2611 are formed on the connecting end of the inserting arm 261.

The locking button 262 is movably mounted in the inserting arm 261, partially extends out of the inserting arm 261 and has an inner end, an outer end and a guiding inclined face 2621. The inner end of the locking button 262 is mounted in the inserting arm 261. The outer end of the locking button 262 extends out of the outer side of the inserting arm 261, engages in the mounting hole of the connecting mount 21 and abuts the positioning block 222 of the pressing button 22. The guiding inclined face 2621 is formed on the outer end of the locking button 262 to enable the inserting arm 261 to be mounted into the inserting hole 211 of the corresponding connecting mount 21 smoothly.

The locking button spring 263 is mounted in the inserting arm 261 and abuts the inner end of the locking button 262 to enable the locking button 262 to move relative to the inserting arm 261. The ejecting button 265 is movably mounted in the inserting arm 261, partially extends out of the inserting arm 261 and has an inner end and an outer end. The inner end of the ejecting button 265 is mounted in the inserting arm 261. The outer end of the ejecting button 265 extends out of the inserting end of the inserting arm 261 and is mounted in the inserting hole 211 of the corresponding connecting mount 21. The ejecting button spring 264 is mounted in the inserting arm 261 and abuts the inner end of the ejecting button 265 to enable the ejecting button 256 to move relative to the inserting arm 261. Preferably, the locking button spring 263, the ejecting button spring 264 and the holding lever spring 27 also can be elastic slices or plastic elastomer.

The primary frame 25 may be U-shaped, is pivotally connected to the inserting segments 26 to enable the primary frame 25 to rotate relative to the inserting segments 26 and has two pivot ends. The pivot ends of the primary frame 25 are respectively connected to the connecting ends of the inserting arms 261 and each pivot end has two inclined faces 251. The inclined faces 251 are formed on the pivot end of the primary frame 25 and face to the inclined faces 2611 of the corresponding inserting arm 261.

The supporting arm 20C is telescopically and pivotally connected to the connecting frame 20B and has a top end and a bottom end. The top end of the supporting arm 20C is connected to the primary frame 25 of the connecting frame 20B. The bottom end of the supporting arm 20C is connected to the seat 13 near the lower end of the seat 13.

The table 30 is detachably mounted on the primary frame 25 of the connecting frame 20B.

Figure 9:
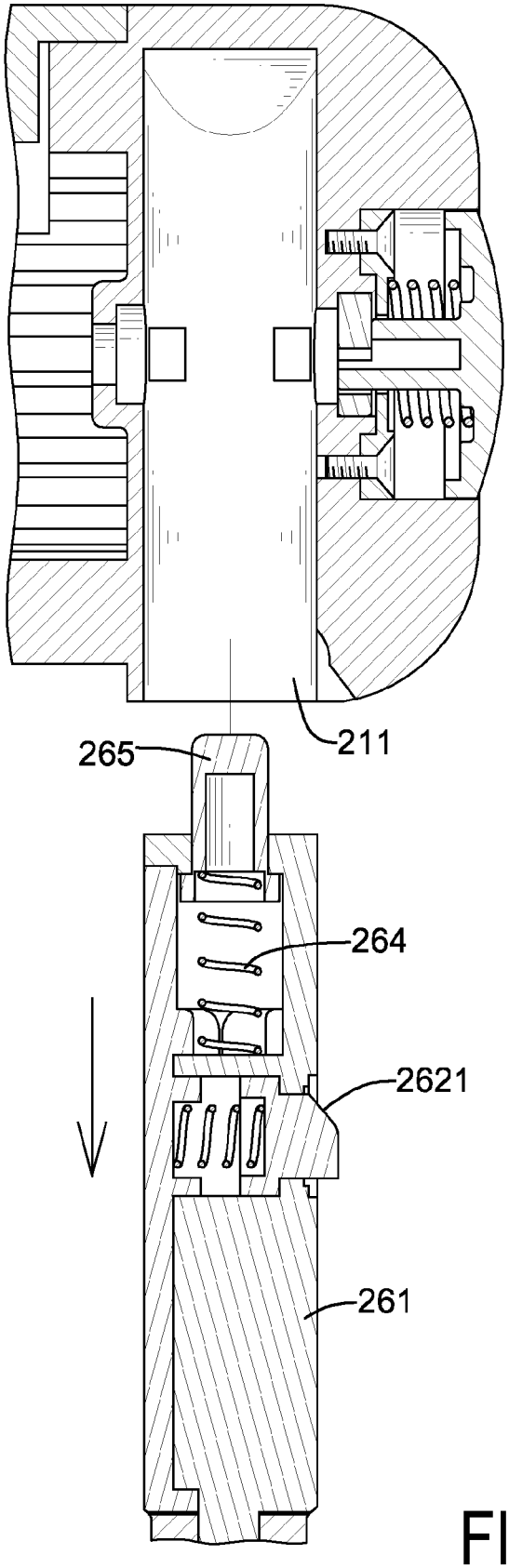
FIG. 9 is an operational and cross section side view of the connecting frame of the highchair in FIG. 1 separating from the connecting segment of the highchair.
Figure 11:
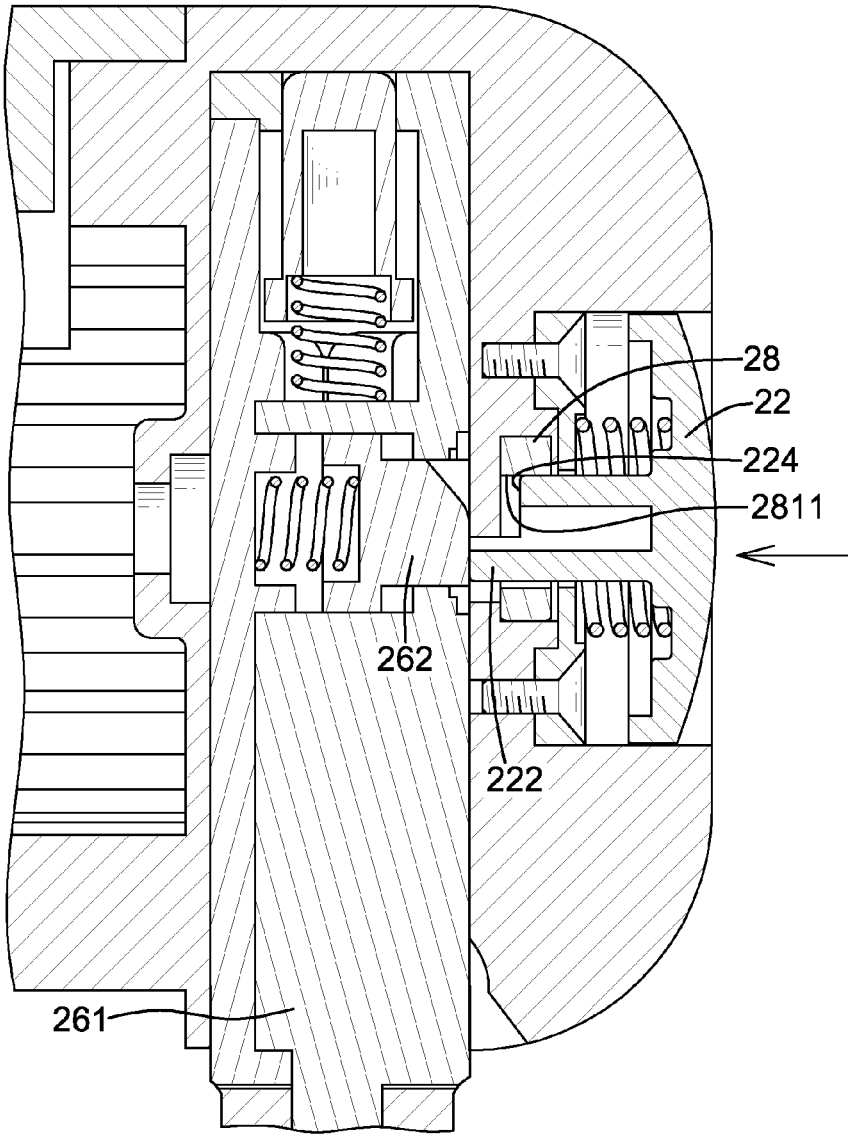
FIG. 11 is an operational and cross section side view of the connecting segment and the connecting frame of the highchair in FIG. 10.
Figure 12:
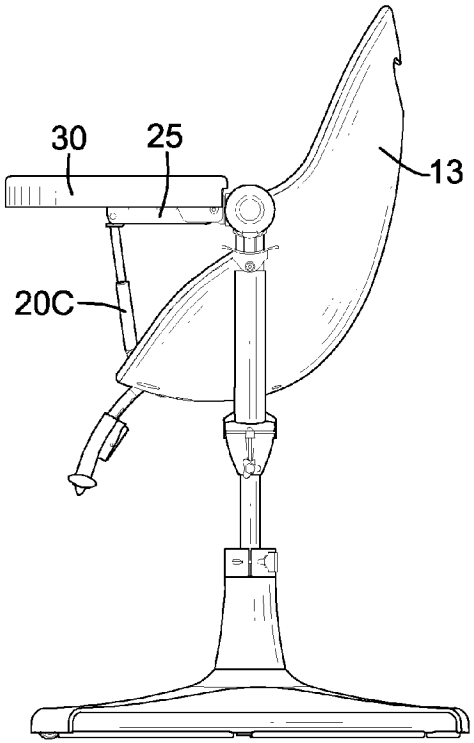
FIG. 12 is a side view of the highchair in FIG. 1.
Figure 13:
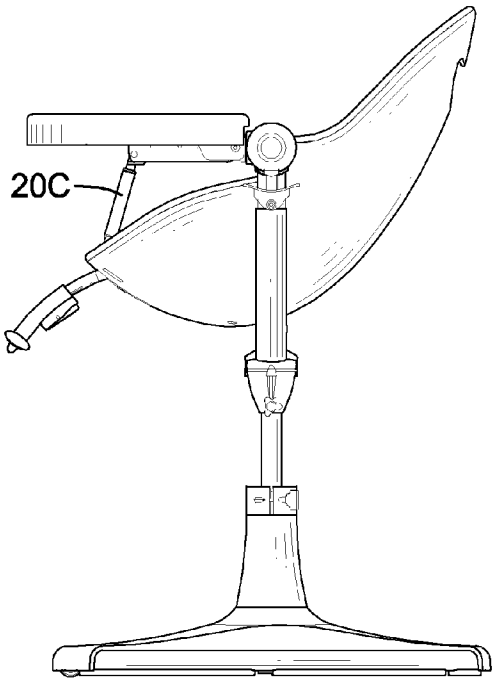
FIG. 13 is an operational side view of the highchair in FIG. 1.
Figure 14:
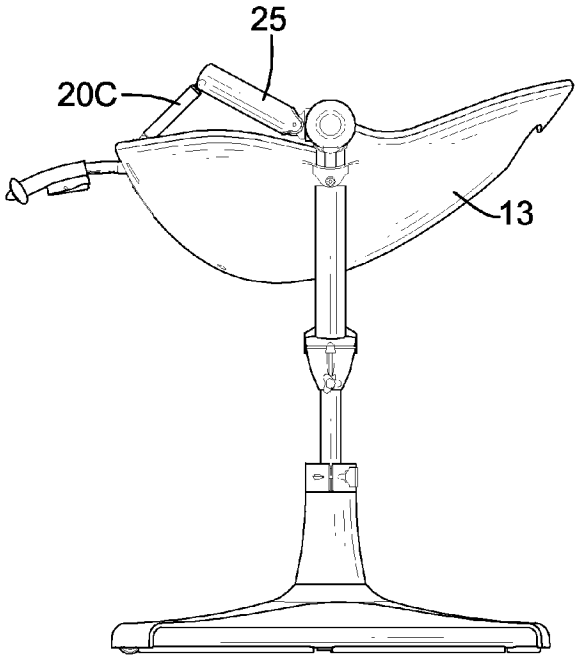
FIG. 14 is another operational side view of the highchair in FIG. 1.
Figure 15:
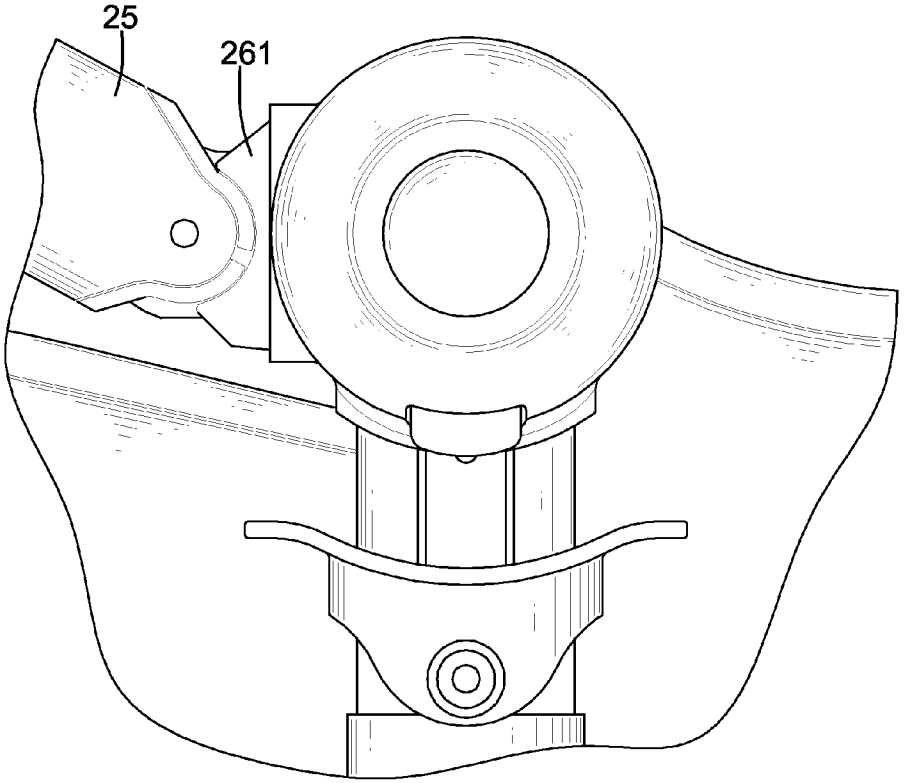
FIG. 15 is an enlarged side view of the highchair in FIG. 14.
Figure 18:
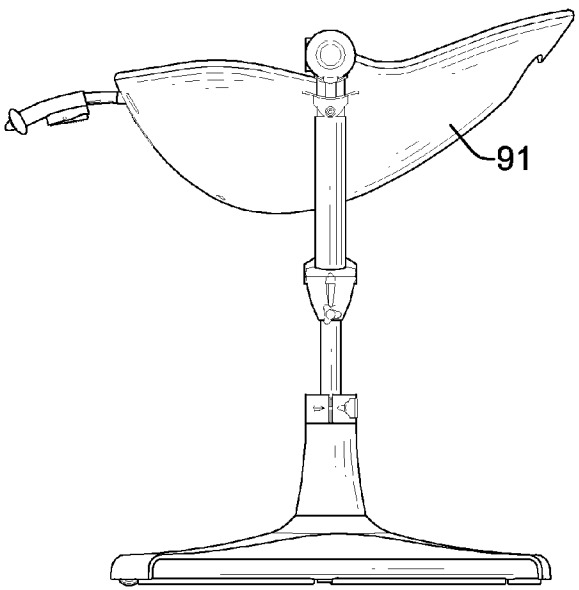
FIG.18 PRIOR ART
FIG. 18 is another operational side view of the highchair in FIG. 16.
Figure 17:
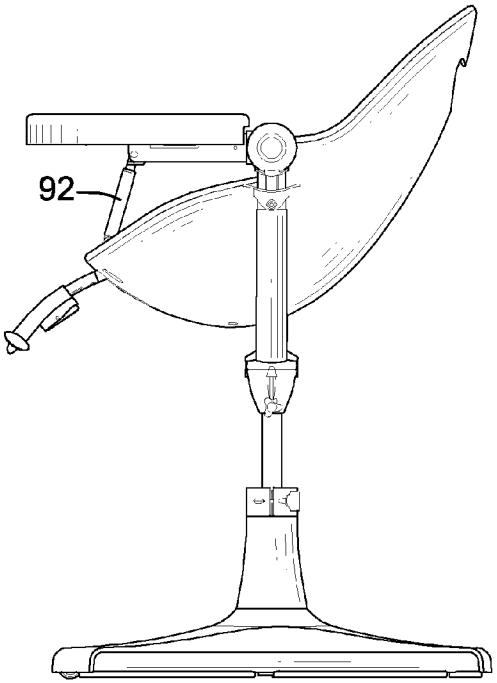
FIG.17 PRIOR ART
FIG. 17 is an operational side view of the highchair in FIG. 16.
Figure 16:
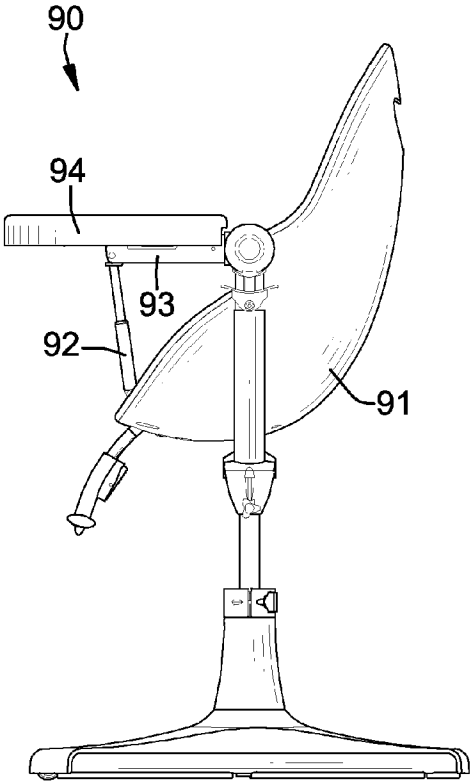
FIG.16 PRIOR ART
FIG. 16 is a side view of a highchair in accordance with the prior art.
Figure 19:
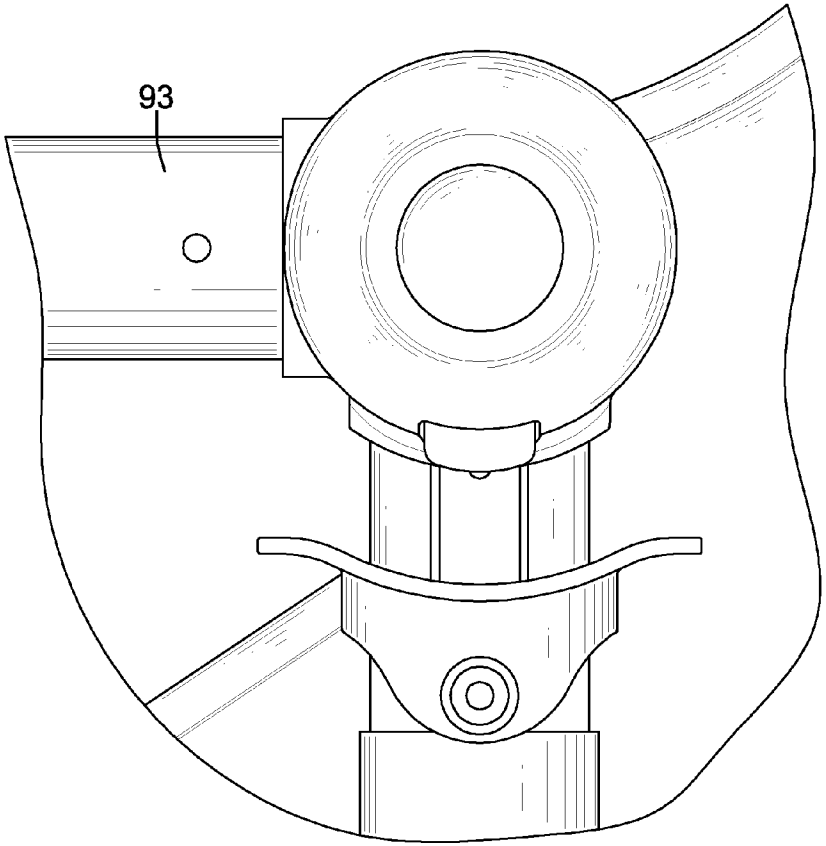
FIG.19 PRIOR ART
FIG. 19 is an enlarged side view of the highchair in FIG. 16.

With reference to FIGS. 10 and 11, when a user wants to separate one of the inserting segments 26 of the connecting frame 20B from the corresponding connecting segment 20A, the pressing button 22 is pressed inwardly to enable the locking button 262 to move into the inserting arm 261 and to separate from the mounting hole of the connecting mount 21 by the positioning block 222 abutting the locking button 262. With reference to FIG. 9, when the locking button 262 moves into the inserting arm 261, the ejecting button spring 264 will push the ejecting button 265 to move out of the inserting arm 261 and to abut the connecting mount 21. Then, the inserting arm 261 can be separated from the inserting hole 211 of the corresponding connecting mount 21 easily.

With reference to FIG. 3, the pressing button 22 can be pressed relative to the connecting mount 21 such as the aforementioned due to the operation between the holding lever 28 and the holding lever spring 27 of the corresponding connecting segments 20A.

With reference to FIGS. 5 and 10, the positioning block 222 of the pressing button 22 engages in the positioning region 2812 of the holding hole 281 of the holding lever by the holding lever spring 27 pressing the holding end of the holding lever 28, and the stopping protrusion 282 of the holding lever 28 abuts against the stopping surface 224 of the pressing protrusion 221. Then, the pressing button 22 cannot press inwardly by the engagement between the positioning block 222, the stopping surface 224, the holding hole 281 and the stopping protrusion 282.

Furthermore, with reference to FIG. 6, when the holding lever 28 is pushed upwardly relative to the connecting mount 21 to press the holding lever spring 27, the positioning block 222 disengages from the positioning region 2812 of the holding hole 281 and moves into the through region 2811, and the stopping protrusion 282 disengages from the stopping surface 224 of the pressing protrusion 221. Then, the pressing button 22 can be pressed relative to the connecting mount 21 to press the locking button 262 to move into the inserting arm 261 as shown in FIG. 11.

With reference to FIGS. 12 to 15, when a user wants to adjust the angle of the seat 13 to the lowest position, the primary frame 25 is pivotally connected to the inserting segments 26 and this can enable the primary frame 25 to rotate relative to the seat 13 when the supporting arm 20C is pressed to the shortest length. Then, the user does not need to separate the supporting arm 20C and the primary frame 25 from the seat 13 before adjusting angle of the seat 13 to the lowest position to prevent waking up the baby sleeping in the chair by the separating sound.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A highchair comprising a seat device having a base, a supporting sleeve formed on and protruding from the base with two top ends and a seat detachably connected to the supporting sleeve between the top ends and having two sidewalls, a bracket device connected to the seat device and a table detachably mounted on the bracket device, and the highchair being characterized in that:

the bracket device is connected to the seat device and having two connecting segments respectively connected securely to the top ends of the supporting sleeve and each connecting segment having a connecting mount mounted securely on a corresponding top end of the supporting sleeve and having an inner side connected to one of the sidewalls of the seat;

an outer side;

a front side;

a bottom side;

a mounting hole formed through the bottom side of the connecting mount and mounted around the corresponding top end of the supporting sleeve;

a seat hole formed in the outer side of the connecting mount and communicating with the mounting hole; and an inserting hole formed through the front side of the connecting mount and communicating with the mounting hole and the seat hole of the connecting mount;

a button seat mounted securely in the seat hole of the connecting mount and having a center; and a through hole formed through the center of the button seat and communicating with the seat hole, the mounting hole and the inserting hole of the connecting mount;

a pressing button pressably mounted in the seat hole of the connecting mount, connected to the button seat and having an inner side; and a button spring mounted around the pressing button and abutting between the button seat and the inner side of the pressing button;

a connecting frame connecting to the connecting segments and having two inserting segments respectively inserted in the inserting holes of the connecting segments and each inserting segment having an inserting arm having an inserting end inserted in the inserting hole of a corresponding connecting mount;

a connecting end;

an inner side; and an outer side;

a locking button movably mounted in the inserting arm, partially extending out of the outer side of the inserting arm between the inserting end and the connecting end of the inserting arm and having an inner end mounted in the inserting arm; and an outer end extending out of the outer side of the inserting arm, engaging in the mounting hole of the connecting mount and abutting the pressing button; and a locking button spring mounted in the inserting arm and abutting the inner end of the locking button to enable the locking button to move relative to the inserting arm; and a primary frame pivotally connected to the inserting segments to enable the primary frame to rotate relative to the inserting segments and the seat of the seat device, the primary frame being adapted to mount below and hold the table on the bracket device and having two pivot ends respectively connected to the connecting ends of the inserting arms; and a supporting arm telescopically and pivotally connected to the primary frame of the connecting frame, connected to the seat and having a top end connected to the primary frame of the connecting frame; and a bottom end connected to the seat.

2. The highchair as claimed in claim 1, wherein each inserting segment has an ejecting button movably mounted in the inserting end of the inserting arm, being perpendicular to the locking button, partially extending out of the inserting end of the inserting arm and having an inner end mounted in the inserting arm; and an outer end extending out of the inserting end of the inserting arm and mounted in the inserting hole of the corresponding connecting mount; and an ejecting button spring mounted in the inserting arm and abutting the inner end of the ejecting button to enable the ejecting button to move relative to the inserting arm.

3. The highchair as claimed in claim 2, wherein the locking button of each inserting segment has a guiding inclined face formed on the outer end of the locking button to enable the inserting arm to be mounted into the inserting hole of the corresponding connecting mount smoothly.

4. The highchair as claimed in claim 3, wherein the pressing button of each connecting segment has a center; and a pressing protrusion formed on and protruding from the inner side of the pressing button and having a diameter;

a free end extending in the through hole of the button seat;

a stopping surface formed on the free end of the pressing protrusion; and a positioning block partially formed on and protruding from the stopping surface of the pressing protrusion and extending into the mounting hole of the connecting mount via the through hole of the button seat;

the button spring is mounted around the pressing protrusion of the pressing button and abuts between the button seat and the inner side of the pressing button; and each connecting segment has a holding lever mounted movably in the corresponding connecting mount via the mounting hole of the corresponding connecting mount and having a holding end mounted in the mounting hole of the corresponding connecting mount;

a holding hole formed through the holding end, mounted around the positioning block of the pressing protrusion and having an upper section;

a lower section;

a positioning region defined in the upper section of the holding hole, engaging the positioning block of the pressing protrusion and having a diameter; and a through region defined in the lower section of the holding hole below the positioning region and having a diameter wider than the diameter of the positioning region to enable the pressing protrusion to move through the holding lever via the through region of the holding hole; and a stopping protrusion formed on the holding lever and protruding inward the upper section of the holding hole and abutting the stopping surface of the pressing protrusion; and a holding lever spring mounted between the connecting mount and the holding end of the holding lever to enable the stopping protrusion to abut the stopping surface of the pressing protrusion and to enable the positioning block to be mounted in the positioning region of the holding hole.

5. The highchair as claimed in claim 4, wherein the inserting arm of each inserting segment has two inclined faces formed on the connecting end of the inserting arm; and the primary frame is U-shaped and each pivot end of the primary frame has two inclined faces formed on the pivot end of the primary frame and facing the inclined faces of a corresponding inserting arm.

6. The highchair as claimed in claim 5, wherein the pressing button of each connecting segment has multiple hooks formed on and protruding from the inner side of the pressing button at intervals around the pressing button and hooked to the button seat to hold the pressing button in the seat hole of the corresponding connecting mount.

7. The highchair as claimed in claim 3, wherein the inserting arm of each inserting segment has two inclined faces formed on the connecting end of the inserting arm; and the primary frame is U-shaped and each pivot end of the primary frame has two inclined faces formed on the pivot end of the primary frame and facing the inclined faces of a corresponding inserting arm.

8. The highchair as claimed in claim 2, wherein the pressing button of each connecting segment has a center; and a pressing protrusion formed on and protruding from the inner side of the pressing button and having a diameter;

a free end extending in the through hole of the button seat;

a stopping surface formed on the free end of the pressing protrusion; and a positioning block partially formed on and protruding from the stopping surface of the pressing protrusion and extending into the mounting hole of the connecting mount via the through hole of the button seat;

the button spring is mounted around the pressing protrusion of the pressing button and abuts between the button seat and the inner side of the pressing button; and each connecting segment has a holding lever mounted movably in the corresponding connecting mount via the mounting hole of the corresponding connecting mount and having a holding end mounted in the mounting hole of the corresponding connecting mount;

a holding hole formed through the holding end, mounted around the positioning block of the pressing protrusion and having an upper section;

a lower section;

a positioning region defined in the upper section of the holding hole, engaging the positioning block of the pressing protrusion and having a diameter; and a through region defined in the lower section of the holding hole below the positioning region and having a diameter wider than the diameter of the positioning region to enable the pressing protrusion to move through the holding lever via the through region of the holding hole; and a stopping protrusion formed on the holding lever and protruding inward the upper section of the holding hole and abutting the stopping surface of the pressing protrusion; and a holding lever spring mounted between the connecting mount and the holding end of the holding lever to enable the stopping protrusion to abut the stopping surface of the pressing protrusion and to enable the positioning block to be mounted in the positioning region of the holding hole.

9. The highchair as claimed in claim 2, wherein the inserting arm of each inserting segment has two inclined faces formed on the connecting end of the inserting arm; and the primary frame is U-shaped and each pivot end of the primary frame has two inclined faces formed on the pivot end of the primary frame and facing the inclined faces of a corresponding inserting arm.

10. The highchair as claimed in claim 1, wherein the locking button of each inserting segment has a guiding inclined face formed on the outer end of the locking button to enable the inserting arm to be mounted into the inserting hole of the corresponding connecting mount smoothly.

11. The highchair as claimed in claim 1, wherein the pressing button of each connecting segment has a center; and a pressing protrusion formed on and protruding from the inner side of the pressing button and having a diameter;

a free end extending in the through hole of the button seat;

a stopping surface formed on the free end of the pressing protrusion; and a positioning block partially formed on and protruding from the stopping surface of the pressing protrusion and extending into the mounting hole of the connecting mount via the through hole of the button seat;

the button spring is mounted around the pressing protrusion of the pressing button and abuts between the button seat and the inner side of the pressing button; and each connecting segment has a holding lever mounted movably in the corresponding connecting mount via the mounting hole of the corresponding connecting mount and having a holding end mounted in the mounting hole of the corresponding connecting mount;

a holding hole formed through the holding end, mounted around the positioning block of the pressing protrusion and having an upper section;

a lower section;

a positioning region defined in the upper section of the holding hole, engaging the positioning block of the pressing protrusion and having a diameter; and a through region defined in the lower section of the holding hole below the positioning region and having a diameter wider than the diameter of the positioning region to enable the pressing protrusion to move through the holding lever via the through region of the holding hole; and a stopping protrusion formed on the holding lever and protruding inward the upper section of the holding hole and abutting the stopping surface of the pressing protrusion; and a holding lever spring mounted between the connecting mount and the holding end of the holding lever to enable the stopping protrusion to abut the stopping surface of the pressing protrusion and to enable the positioning block to be mounted in the positioning region of the holding hole.

12. The highchair as claimed in claim 1, wherein the inserting arm of each inserting segment has two inclined faces formed on the connecting end of the inserting arm; and the primary frame is U-shaped and each pivot end of the primary frame has two inclined faces formed on the pivot end of the primary frame and facing the inclined faces of a corresponding inserting arm.

13. The highchair as claimed in claim 1, wherein the pressing button of each connecting segment has multiple hooks formed on and protruding from the inner side of the pressing button at intervals around the pressing button and hooked to the button seat to hold the pressing button in the seat hole of the corresponding connecting mount.

* * * * *